US005222265A

United States Patent [19]

Hermansson

[11] Patent Number: 5,222,265

[45] Date of Patent: Jun. 29, 1993

[54] LID PRYING TOOL

[76] Inventor: Edward Hermansson, 1330 Stanbury Road, Oakville, Ontario, Canada, L6L 2Y4

[21] Appl. No.: 875,899

[22] Filed: Apr. 29, 1992

[51] Int. Cl.[5] ..... B67B 7/44

[52] U.S. Cl. ..... 7/156; 81/3.09; 81/3.55

[58] Field of Search ..... 7/105, 143, 144, 151, 7/156; 81/3.07, 3.09, 3.55

[56] References Cited

U.S. PATENT DOCUMENTS 4,173,909 11/1977 Cleveland et al. .
4,747,173 5/1988 Marceau ..... 7/156
4,829,619 5/1989 Edgerton ..... 7/156
4,967,436 12/1989 Russell .

FOREIGN PATENT DOCUMENTS 1215964 7/1983 Canada .
1181604 6/1984 Canada .

*Primary Examiner*—James G. Smith
*Attorney, Agent, or Firm*—Bereskin & Parr

[57] ABSTRACT

A lid prying tool is disclosed having a handle at one end, a hook at the other end, and a first fulcrum located in between. The tool further includes a knife edge, and a second fulcrum located between the handle and the knife edge. In one embodiment of the invention, the first fulcrum and the associated hook are located on the opposite side of the tool from the second fulcrum and the associated knife blade. In this manner the tool is reversible to accomplish both cutting and prying actions on opposite sides of the tool.

13 Claims, 3 Drawing Sheets

LID PRYING TOOL

FIELD OF THE INVENTION

This invention relates to the field of tools which may be used to open containers. In particular, this invention relates to a tool of the type used to pry a closely fitting lid off a container, such as a bucket.

BACKGROUND OF THE INVENTION

Various types of lid removal tools have been proposed in the past. Such tools have been developed to conveniently remove lids from various types of containers, including plastic bucket containers having lids with a skirt-type peripheral flange fitted over the top of the container or bucket. In some cases, the lids are so securely attached that it is necessary to cut the skirt to remove the lid. Such lids are most commonly used in association with liquid or semi-liquid products such as foodstuffs or paints and sealers. Typically a sharp knife is required to cut through the dense plastic. Such a cutting operation is awkward and creates a significant risk of a slip which is dangerous.

For example, U.S. Pat. No. 4,967,436 to Russell relates to a combination lid removal tool having a knife blade 22 which can be extended into a cutting position at one end of the tool. However, in this position the knife edge 22 is completely exposed and acts exactly like a regular knife creating all the dangerous cutting potential of a regular knife.

Other safer devices have been proposed, without knife blades. For example, Canadian patents No. 1,181,604 and 1,215,964 both relate to lid prying tools, but tools which do not provide any complementary means to cut the skirt of the bucket lid in a safe, efficient and easy manner to allow the easy removal of the lid from the container. Also, U.S. Pat. No. 4,173,909 to Cleveland relates to a lid lifter for recloseable self-sealing buckets. Again however no cutting edge is provided. Further this invention relies on a hoop attachment around the bucket which is cumbersome and difficult to achieve effectively.

SUMMARY OF THE PRESENT INVENTION

The present invention is directed to a combination of a lid prying tool and a cutting edge which provides a safe, easy, efficient method of removing closely fitting lids from buckets by allowing the peripheral skirts at bucket lids to be easily and efficiently cut. The present invention further provides a tool which while cutting the skirt, leaves any elastomeric seal intact whereby the lid may be remounted on the bucket in a tight sealing relationship. The present invention further provides for a tool which facilitates the remounting of the lid on the bucket by having an appropriate striking surface formed into the tool.

According to the present invention there is provided a lid prying tool comprising:

a body having a handle at one end;

a first fulcrum and an associated hook means on said body, wherein said first fulcrum is displaced outwardly from said body beyond a first plane passing through the hook means at one end and the handle at the other end, and said first fulcrum is located generally between said handle and said associated hook means; and a second fulcrum and an associated knife means on the body, wherein said second fulcrum is displaced outwardly of a second plane passing through said knife means at one end and said handle at the other end and said second fulcrum is located generally between said handle and said knife means.

BRIEF DESCRIPTION OF THE DRAWINGS

Reference will now be made to a preferred embodiment of the invention illustrated by way of example only in the attached drawings and in which.

DESCRIPTION OF PREFERRED EMBODIMENT

Figures 1, 2, 3:
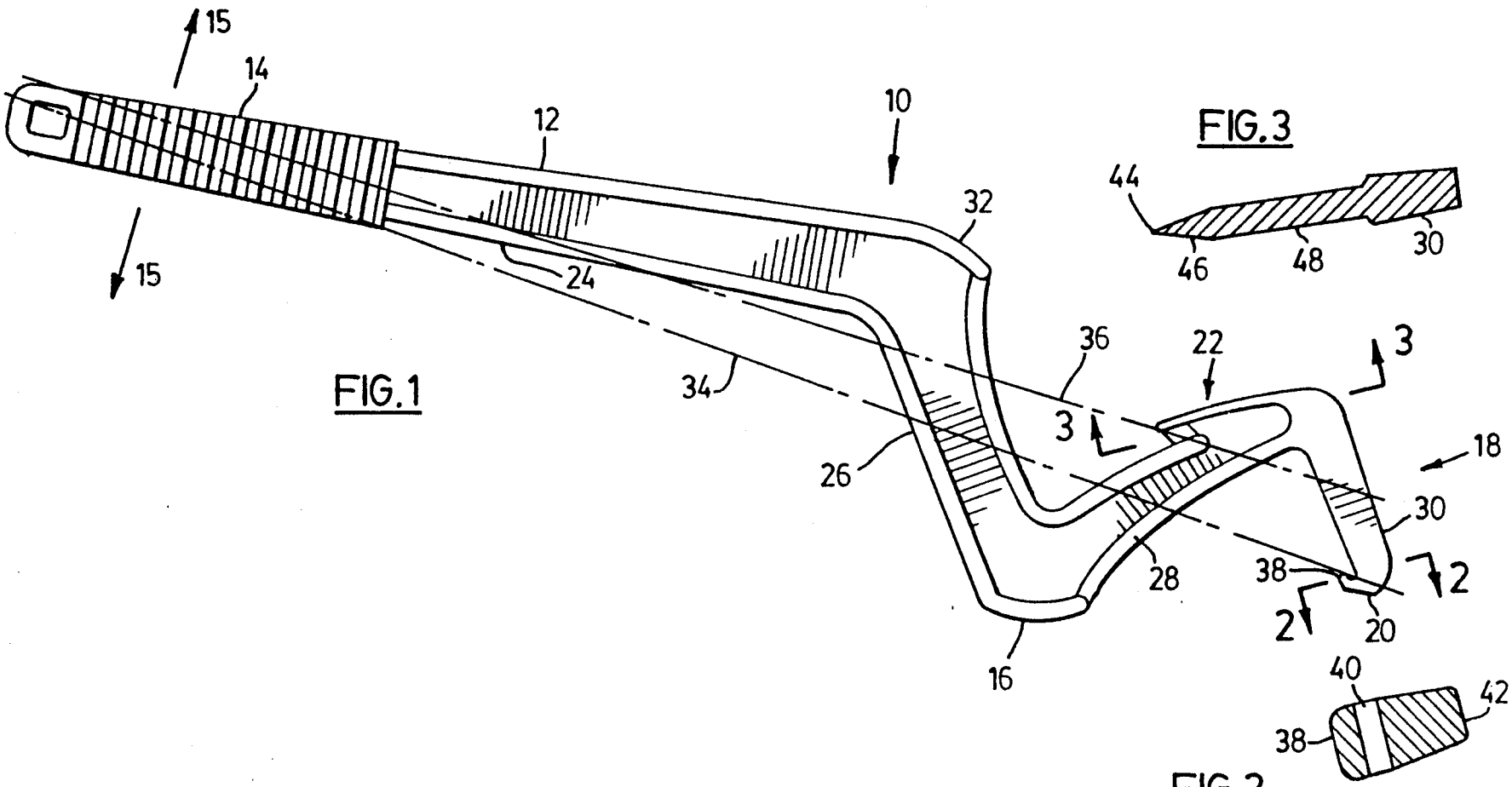
FIG. 1 a side view of a lid prying tool according to the present invention.
FIG. 2 is a close-up and enlarged view of a section along lines 2—2 of FIG. 1.
FIG. 3 is a view in section and enlarged along lines 3—3 of FIG. 1.

FIG. 1 shows a lid prying tool indicated generally at 10. The lid prying tool includes a body 12 having a handle 14 at one end. A first fulcrum 16 is located generally towards the other end 18 from the handle 14. Associated with the first fulcrum 16 is a hook means 20. A knife means is illustrated at 22.

As can be seen in FIG. 1, the body 12 includes a first limb 24 extending outwardly of the handle, a second limb 26 extending at a different angle than first limb 24, a third limb 28 extending at a different angle again bending upwardly in the view of FIG. 1 and a fourth limb 30. Located between first and second limbs 24 and 26 is a second fulcrum 32. Also shown in FIG. 1 in ghost outlines are a first plane 34 and a second plane 36.

As can be seen from FIG. 1, the first fulcrum 16 is displaced outwardly from the plane 34 joining the handle 14 and the hook means 20. Thus, the fulcrum 16 forms a pivot point about which hook 20 can be rotated by manipulation of the handle 14 in the direction of arrow 15. Similarly, the second fulcrum 32 is outward of plane 36 which extends between handle 14 and knife means 22. It will be appreciated that in the preferred embodiment the hook means 20 and the knife means 22 are on opposite sides of the body 12, as shown in FIG. 1, and thus first fulcrum 16 and second fulcrum 32 are also on opposite sides of the body and extend outwardly in opposite directions from planes 34 and 36 respectively. As with the fulcrum 16, the fulcrum 32 acts as a pivot point around which knife means 22 can be rotated by manipulation of the handle 14 in the direction of arrow 15.

FIG. 2 shows a cross sectional enlarged view along lines 2—2 of FIG. 1. It can be seen that the hook means 20 comprises a lip 38 separated by a groove 40 from the shaft 42 of the body 12. The purpose of the lip 38 and the groove 40 will be explained in more detail below.

FIG. 3 shows a cross section enlarged view along lines 3—3 of FIG. 1. As shown, knife means 22 includes a knife edge 44 on a tapered blade 46. The blade is attached to the body 12 at portion 48 and ends at limb 30. Good results have been achieved when the knife means 22 is integrally molded into the body 12 of the present invention. However, it will be appreciated by those skilled in the art that the knife edge 44 and blade 46 could be retrofitted into the body 12 in the event that this would be desirable from a manufacturing point of view.

Figure 4:
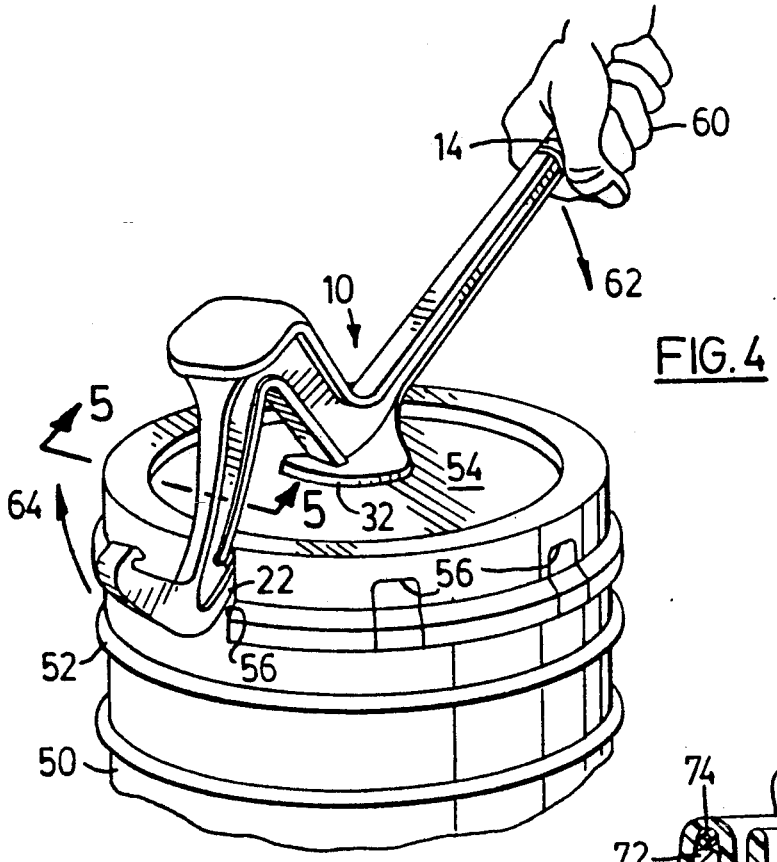
FIG. 4 is a view of the present invention in use in cutting a skirt of a bucket lid.

Turning to FIG. 4, the lid prying tool 10 according to the present invention can be seen in use. FIG. 4 shows a bucket 50 having a lower rim 52 and a lid 54. The bucket 50 is of the type having a liquid seal and having a plurality of weakened sections indicated at 56 which are intended to be cut. As shown in FIG. 4, a hand 60 is gripping handle 14 and depressing the handle 14 in the direction of arrow 62. This is taking place at the same time as second pivot 32 is resting on the bucket lid 54. This has the effect of raising the free end of the prying tool upwardly in the direction of arrow 64. It can be seen that the knife means 22 is being driven up against a weakened section 56 to cause a split or cut in a depending skirt 68 of the bucket lid 54.

Figure 5:
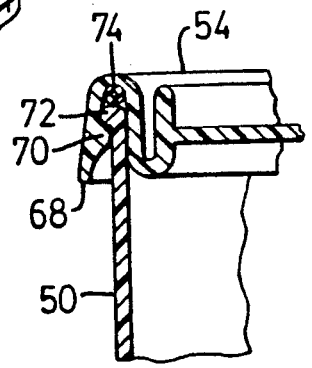
FIG. 5 is a section through lines 5—5 of FIG. 4 illustrating the bucket and lid interface.

Shown in FIG. 5 is a cross sectional view of the bucket lid 54 in place on a bucket 50. It can be seen that the depending skirt 68 includes an inward rim 70 which fits under an outward lip 72 formed around the upper outer edge of the bucket 50. Located between the bucket lid 54 and the rim 72 of the bucket 50 is a gasket 74. This gasket 74 assists in forming a liquid-tight seal. It can now be appreciated that the present invention allows the depending skirt 68 to be cut or split in an upwardly manner in a way that allows the cut to be controlled. The instant invention prevents the gasket 74 from being accidentally severed which often is the case when a knife is used to form a slit by beginning at the top edge of the skirt 68. Further, the use of a lever arm makes the cutting action much easier to control, and much safer, with less physical effort than using a standard utility knife.

Figure 6:
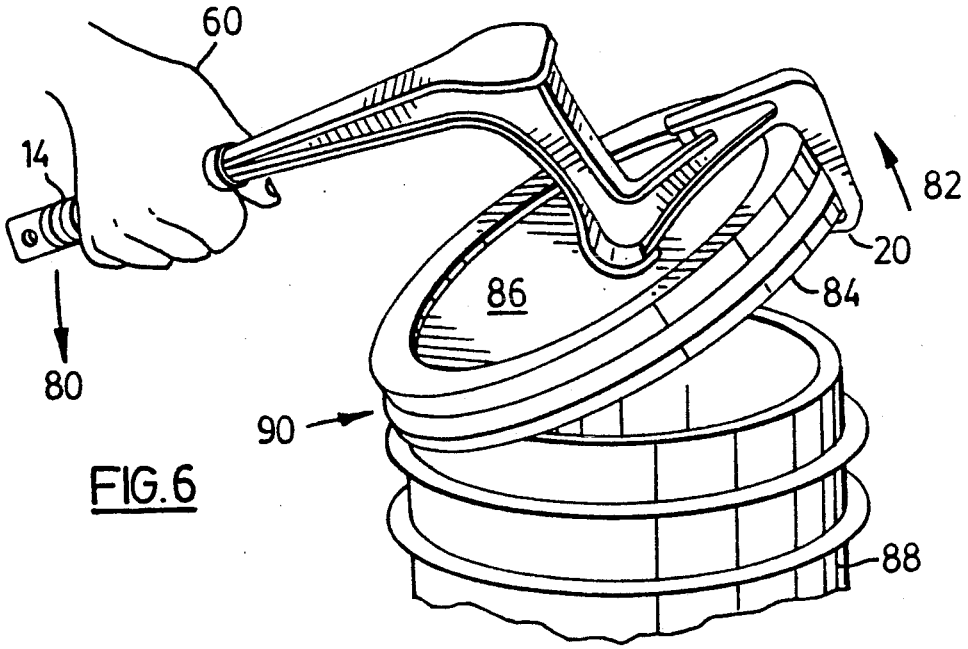
FIG. 6 is a view showing the instant application being used to pry a bucket lid off a container.

Turning to FIG. 6, the lid prying device 10 is shown in a reverse position from that illustrated in FIG. 4. In FIG. 6, again the hand 60 is manipulating the handle 14 of the tool 10 downwardly in direction of arrow 80. This has the effect of moving hook means 20 in the direction of arrow 82. Once the hook means 20 has pryed the rim 84 of the lid 86 away from the bucket 88 the lid 86 will pivot about a far side of the lid shown at 90. If necessary, the device 10 can be walked about the lid 86 to free it at sufficient points around its circumference to allow for easy removal. It will now be appreciated that lip 38 and the groove 40 are to permit the hook means 20 to register with an underside of the skirt 68 of bucket lids 54 or 86. Other configurations are possible for the hook means 20, provided that sufficient width is left to accommodate different thicknesses of bucket lids.

Figure 7:
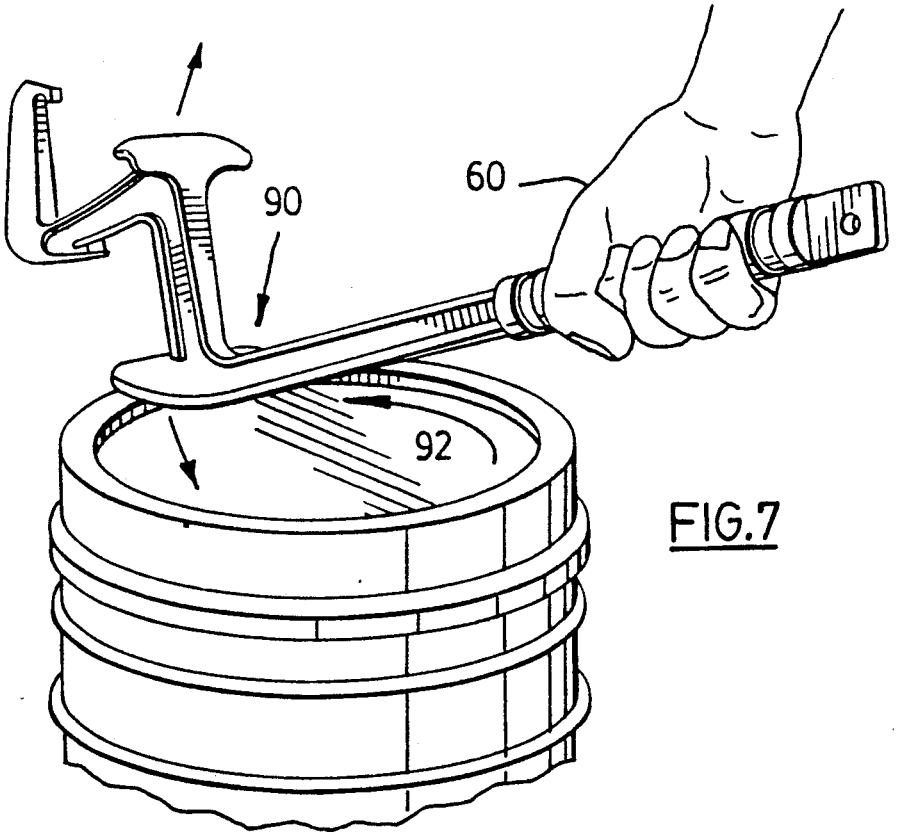
FIG. 7 shows the present invention being used to secure a bucket lid back onto a container.

In FIG. 7, there is shown the use of the lid prying tool 10 according to the present invention as a pounding tool or hammer to reseal the lid 86 onto a bucket 88 by tamping the lid 86 around the upper outer circumference, with second fulcrum 32. Arrow 90 indicates the hammering direction, and arrow 92 indicates that hammering should occur around the lid.

Good results have been achieved when the present invention is formed from cast aluminum. However, it might also be formed from molded plastic, provided there was adequate provision for strength of the body 12. Further, any molded plastic configuration would have to be provided with a sufficient knife means 22 to adequately cut the depending skirts of buckets.

As will be seen in FIG. 1, the handle 14 is preferably formed with raised ridges, to provide a comfortable yet strong gripping surface. The handle 14 may also be conveniently formed with a hanging hole 15, to allow the device 10 to be easily stored on a hook or the like.

Good results have been achieved when the overall length of the deice 10 is 20.69", where the handle is 5.5" long, where the horizontal distance to the end of the first limb from the end of the handle is approximately 13.03"; when the horizontal distance to the end of the second limb is 15.64" and where the horizontal distance to the end of the third limb is 19". The knife may be made 1.875" long, with a tapered point of 0.438". The first and second fulcrums are preferably approximately 1.65" by 2.25", and are generally rectangular, with rounded corners. Satisfactory results have been obtained with groove 40 being 0.15" width, but this may vary to suit different bucket lid thicknesses.

The foregoing description relates to a preferred embodiment only and it will be appreciated by those skilled in the art that various modifications and alterations can be made without departing from the scope of the present invention. Some of these have been suggested above, and others will be apparent to those skilled in the art.

I claim:

1. A lid prying tool comprising:

a body having a handle at one end;

a first fulcrum and an associated hook means on said body, wherein said first fulcrum is displaced outwardly from said body beyond a first plane passing through the hook means at one end and the handle at the other end, and said first fulcrum is located between said handle and said associated hook means; and a second fulcrum and an associated knife means on the body wherein said second fulcrum is displaced outwardly of a second a plane passing through said knife means at one end and said handle at the other end and said second fulcrum is located between said handle and said associated knife means.

2. A lid prying tool as claimed in claim 1 wherein said first fulcrum and associated hook means are located on one side of the body, and the second fulcrum and associated knife means are located on another side of said body and said tool is reversible.

3. A lid prying tool as claimed in claim 2 wherein both said first and second fulcrums are located between said handle and said associated hook means and said knife means.

4. A lid prying tool as claimed in claim 3 wherein said body is a continuous body having a first bend at said second fulcrum and a second bend at said first fulcrum said second bend being in an opposite direction to said first bend.

5. A lid prying tool as claimed in claim 4 wherein said body further includes a third bend between said hook means and said knife means.

6. A lid prying tool as claimed in claim 5 wherein said third bend is in the same direction as said first bend.

7. A lid prying tool as claimed in claim 6 wherein said body is I-shaped in cross-section for at least part of its length.

8. A lid prying tool as claimed in claim 7 wherein said second fulcrum comprises an enlarged section of a flange of said I-shaped cross-section, which gently curves around said first bend.

9. A lid prying tool as claimed in claim 8 wherein said first fulcrum comprises an enlarged section of the other of said flanges of said I-section, and said first fulcrum gently curves around said second bend.

10. A lid prying tool as claimed in claim 9 wherein said body portion tapers to an end remote from said handle.

11. A lid prying tool as claimed in claim 10 wherein said handle includes a hanging opening.

12. A lid prying tool as claimed in claim 9 wherein said first fulcrum comprises a sufficiently enlarged area to form a striking surface for tamping down a lid onto a bucket.

13. A lid prying tool as claimed in claim 8 herein said second fulcrum comprises a sufficiently enlarged area to form a striking surface for tamping down a lid onto a bucket.

* * * * *